US008167166B2

(12) United States Patent
Kidd et al.

(10) Patent No.: US 8,167,166 B2
(45) Date of Patent: May 1, 2012

(54) CONTAINER

(75) Inventors: Allen Kidd, Placentia, CA (US); Stephen P. Zapatka, Kingston, IL (US)

(73) Assignee: Peninsula Packaging, LLC, Exeter, CA (US)

( * ) Notice: Subject to any disclaimer, the term of this patent is extended or adjusted under 35 U.S.C. 154(b) by 673 days.

(21) Appl. No.: 12/275,649

(22) Filed: Nov. 21, 2008

(65) Prior Publication Data

US 2009/0134180 A1 May 28, 2009

Related U.S. Application Data

(60) Provisional application No. 60/989,864, filed on Nov. 23, 2007.

(51) Int. Cl.
*B65D 43/22* (2006.01)
*B65D 43/16* (2006.01)
*B65D 45/18* (2006.01)

(52) U.S. Cl. ..... 220/835; 220/4.23; 220/326; 220/839

(58) Field of Classification Search ..... 220/788, 220/839, 822, 824, 825, 4.23, 324, 835, 326
See application file for complete search history.

(56) References Cited

U.S. PATENT DOCUMENTS

| | | | | |
|---|---|---|---|---|
| 3,351,227 | A * | 11/1967 | Collie | 220/788 |
| 3,351,270 | A * | 11/1967 | Hohnjec | 220/835 |
| 3,356,277 | A | 12/1967 | Hohnjec | |
| 3,421,682 | A | 1/1969 | Eisenbacli et al. | |
| 3,933,296 | A | 1/1976 | Ruskin et al. | |
| 4,494,650 | A * | 1/1985 | Cullen | 206/315.9 |
| 4,512,474 | A | 4/1985 | Harding | |
| 4,576,330 | A * | 3/1986 | Schepp | 220/315 |
| 4,886,204 | A | 12/1989 | Kalmanides | |
| 5,046,659 | A | 9/1991 | Warburton | |
| 5,156,267 | A * | 10/1992 | Yates et al. | 206/364 |
| 5,169,014 | A | 12/1992 | Hexamer | |
| 5,497,894 | A * | 3/1996 | Krupa et al. | 220/4.23 |
| 5,584,408 | A | 12/1996 | Orkisz | |
| D382,795 | S | 8/1997 | Abayhan et al. | |
| 5,653,345 | A | 8/1997 | Knoss et al. | |
| 5,711,978 | A | 1/1998 | Breen et al. | |
| 5,758,791 | A | 6/1998 | Mangla | |
| 5,979,687 | A | 11/1999 | Hayes et al. | |
| 6,666,348 | B2 | 12/2003 | Fore et al. | |
| 6,845,878 | B2 | 1/2005 | Hayes et al. | |
| 7,204,388 | B2 | 4/2007 | Galland et al. | |
| 7,243,813 | B2 | 7/2007 | Krueger | |

(Continued)

FOREIGN PATENT DOCUMENTS

| | | |
|---|---|---|
| CL | 5638 | 9/2007 |

(Continued)

*Primary Examiner* — Mickey Yu
*Assistant Examiner* — Niki Eloshway
(74) *Attorney, Agent, or Firm* — Loza & Loza LLP; Heidi L. Eisenhut

(57) ABSTRACT

A container having a base with extending sidewalls therefrom and a lid hingedly connected thereto. The container may have an alignment mechanism having a lower alignment member and an upper alignment member locating surface on the base and lid, respectively, at the region where the base and the lid are hingedly connected. The container may have a plurality of locking mechanisms in which each locking mechanism includes an extending latching portion and a corresponding circular opening for engagement thereof. The locking mechanism is configured to securely lock the lid to the base wherein an appropriate amount of pulling force must be applied thereto in order to disengage the lid from the base.

19 Claims, 13 Drawing Sheets

U.S. PATENT DOCUMENTS

| | | | | |
|---|---|---|---|---|
| 7,246,714 | B2 | 7/2007 | Garg et al. | |
| 7,255,231 | B2 | 8/2007 | Andrews et al. | |
| D569,243 | S | 5/2008 | Kidd et al. | |
| 7,597,206 | B2 | 10/2009 | Atkins et al. | |
| 7,819,279 | B2 | 10/2010 | Galland et al. | |
| 2003/0052133 | A1* | 3/2003 | Hayes et al. | 220/835 |
| 2003/0152670 | A1 | 8/2003 | Shih | |
| 2003/0192888 | A1 | 10/2003 | Chang | |
| 2005/0247709 | A1* | 11/2005 | Atkins et al. | 220/4.23 |
| 2006/0289550 | A1 | 12/2006 | Guardigli | |
| 2007/0045631 | A1 | 3/2007 | Endo et al. | |
| 2007/0095848 | A1* | 5/2007 | Galland et al. | 220/784 |
| 2008/0023472 | A1* | 1/2008 | Brandt | 220/4.23 |
| 2009/0134179 | A1 | 5/2009 | Kidd et al. | |
| 2009/0134180 | A1 | 5/2009 | Kidd et al. | |
| 2009/0223966 | A1 | 9/2009 | Kidd et al. | |

FOREIGN PATENT DOCUMENTS

| | | |
|---|---|---|
| EP | 1336569 | 8/2003 |
| EP | 1529077 | 5/2005 |
| FR | 2691701 | 12/1993 |

* cited by examiner

CONTAINER

CLAIM OF PRIORITY UNDER 35 U.S.C. §119

The present Utility Application for Patent claims priority to U.S. Provisional Application No. 60/989,864 entitled "Container" filed Nov. 23, 2007, and hereby expressly incorporated by reference herein.

FIELD

The present invention relates to the field of containers, in particular, to containers having locking mechanisms for preventing unauthorized access to contents of the containers.

BACKGROUND

It is common to use clear hinged containers to transport and package fresh and chilled foods, such as fruit, for selling to consumers. The containers allow the food to be transported with less damage, such as bruising, and provide convenient packaging for consumers who are purchasing the food.

However, the closing mechanisms on prior art containers can be easily opened. As a result, consumers can easily open the containers in the store prior to sale allowing them to sample the food without buying it, drop the food on the store floor causing a slip-and-fall hazard, and in some instances damaging the food such that it cannot be sold and has to be thrown away. Furthermore, the lack of a tight fitting closing or locking mechanism could allow the lid of a container to easily separate from its base during distribution and transportation allowing its contents to spill out damaging the food and ultimately having to be thrown out resulting in lost revenues for the grower, distributor and retailer.

Consequently, a container is needed that has an improved locking mechanism that is easy to engage at the point of packing but is difficult for an individual to disengage as the locking mechanism becomes tighter as an individual tries to separate the lid and base of a container, but with enough pulling force will ultimately defeat the locking mechanism allowing it to be disengaged creating a recloseable type lock.

SUMMARY

In one embodiment, a container, including: (i) a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange including at least two circular openings, the at least two circular openings having a chamfered ring having a plurality of flutes; and (ii) a lid hingedly connected to the base, the lid including at least two extending latching portions, each extending latching portion having a shank and head integrally connected, the head having a base and a cone-shaped pin integrally connected thereto and a plurality of concave grooves separated by a plurality of radially projecting outwardly protrusions wherein the concave grooves uniformly extend upwards along a wall of the base to a first point and then diverge outwardly along a wall of the pin and then converge to a rounded end below a top of the pin is herein disclosed.

The container may further include: (i) a front support bridge, the front support bridge having an upper extending member integrally connected to an upper flange extending from a partial perimeter defined by the lid; and (ii) a front lower extending member integrally connected to the lower flange wherein, when the upper extending member is engaged with the lower extending member, a ventilation gap is maintained between the base and the lid.

The container may further include an alignment mechanism, the alignment mechanism including an alignment member on the base and an alignment member locating surface on the lid, the alignment member and the alignment member locating surface approximately located at a region where the lid and the base hingedly connect.

In some embodiments, the lid and the base are quadrilateral polygons. In some embodiments, the lid comprises a central raised portion. In some embodiments, at least two corners of the central raised portion are concave. In some embodiments, the front bridge and front lower extending member are located at an approximate center of a front edge of the lid. In some embodiments, the front edge of the lid of the central raised portion is concave. In some embodiments, the container includes a first plurality of apertures disposed symmetrically about the central raised portion. In some embodiments, the container includes a second plurality of apertures disposed about a perimeter of the central raised portion. In some embodiments, the container includes a third plurality of apertures disposed about a perimeter of the base. In some embodiments, a material that makes up the container is one of polyethylene terephthalate, polystyrenes, or polypropylenes.

In another embodiment, a locking mechanism for a container, including: (i) at least two circular openings, the at least two circular openings having a chamfered ring having a plurality of flutes; and (ii) at least two corresponding extending latching portions, inserted into the openings, each extending latching portion having a shank and head integrally connected, the head having a base and a cone-shaped pin integrally connected thereto and a first plurality of concave grooves separated by a plurality of radially projecting outwardly protrusions is herein disclosed.

In some embodiments, the first plurality of concave grooves uniformly extend upwards along a wall of the base of the head to a first point and then diverge outwardly along a wall of the pin and then converge to a rounded end below a top of the pin. In some embodiments, a second plurality of concave grooves is symmetrically spaced about the shank. In some embodiments, the first plurality of concave groves and the second plurality of concave grooves are substantially aligned. In some embodiments, the first plurality of concave grooves is symmetrically spaced about an outermost circumference of the head. In some embodiments, the shank is cylindrical-shaped or approximately cylindrical-shaped.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "container" refers to any type of device for holding objects, including a receptacle, a bin, a box, a carton, a case, and a crate. The term "food" refers to any type of edible substance including all types of fruits and vegetables.

Figure 1:
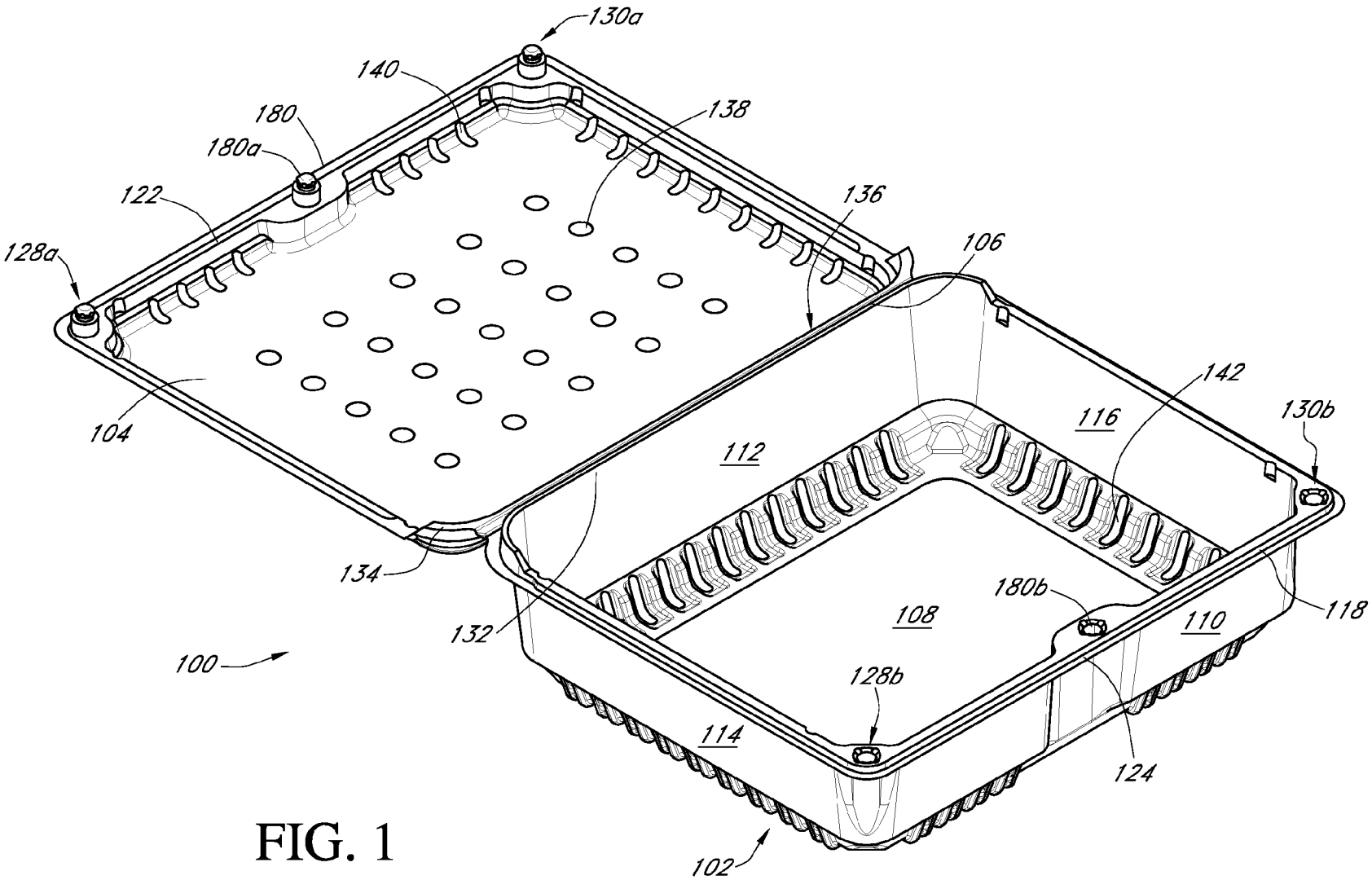
FIG. 1 illustrates a perspective view of a container in an open configuration according to an embodiment of the invention.

FIG. 1 illustrates a perspective view of a container in an open configuration according to an embodiment of the invention. As shown, a container 100 includes a base 102 connected to a lid 104 via a hinge 106. The base 102 includes a bottom 108 and two opposing sidewalls 110 and 112 integrally connected to two opposing end walls 114 and 116. The sidewalls, 110 and 112, and end walls, 114 and 116, extend continuously upwardly from the bottom 108 to form the base 102. The uppermost edges of the sidewalls 110, 112 and the end walls 114, 116 define a perimeter of the base 102 by which a lower flange 118 is integrally connected thereto. The lower flange 118 generally projects in an outwardly or an approximately perpendicular fashion relative to the perimeter as defined previously. The lid 104 may include a central raised portion 120 (not shown, see FIG. 2) integrally connected to an upper flange 122. The central raised portion 120 may have a substantially rectangular or square shape. However, in alternative embodiments, the central raised portion 120 may be in the form of a different shape, such as oval, triangle, square, circular or other polygons. Similar to the lower flange 118, the upper flange 122 generally projects in an outwardly or an approximately perpendicular fashion relative to a perimeter defined by central raised portion 120 (not shown, see FIG. 2). In one embodiment, the central raised portion 120 may have first and second notches 124 and 126 (not shown, see FIG. 2) in the same corners as extending latching portions 128*a* and 130*a* of locking mechanisms 128 and 130 (not shown, see FIG. 2), respectively (explained in more detail below). According to one application, the first and second notches 124 and 126 accommodate an individual's thumbs or other finger in preparation for securing the locking mechanisms 128, 130 (collectively 128*a*, 128*b* and 130*a*, 130*b*) by applying pressure to the extending latching portions 128*a* and 130*a* thereby engaging with circular openings 128*b* and 130*b*. Such action may alternatively be performed by automated closing equipment in a manufacturing environment.

In some embodiments, the container 100 may include an alignment mechanism for aligning the lid 104 and the base 102 in a closed configuration. The alignment member is comprised of a lower alignment member 132 integrally connected to, and projecting in an upwardly fashion, along the entire length of the top perimeter of the sidewall 112 and an upper alignment member locating surface 134 integrally connected to, and projecting in an upwardly fashion, along a back edge 136 of the lid 104, and configured to align the lid 104 and base 102 in a closed configuration. In this manner, when the lid 104 is secured to the base 102, the lower alignment member 132 is substantially captured within the upper alignment member locating surface 134 and maintained in an aligned configuration. Furthermore, the lower alignment member 132 and the upper alignment member locating surface 134 are adjacent to the hinge 106 for substantially precluding lateral movement and premature disengagement of lid 104 from base 102. Alternatively, the lid 104 and base 102 may be hingedly connected according to other methods known in the art.

In some embodiments, the container 100 may include a front bridge 180 for stabilizing a lid 104 of the container 100 and maintaining a front ventilation gap when the container 100 is in a closed position. The front bridge 180 includes an extending latching portion 180*a* and an inwardly recessed pocket 180*b* (similar in configuration to locking mechanisms 128, 130). The extending latching portion 180*a* is disposed on the front side of an upper flange 122, and the inwardly recessed pocket 180*b* is disposed on the front side of a lower flange 118 of a base 102 of the container 100 for capturing the extending latching portion 180*a*. In this manner, when the lid 104 is secured to the base 102, the extending latching member 180*a* is inserted into the inwardly recessed pocket 180*b* until the upper flange 122 of the container 100 abuts the top of the inwardly recessed pocket 180*b*.

Figure 2:
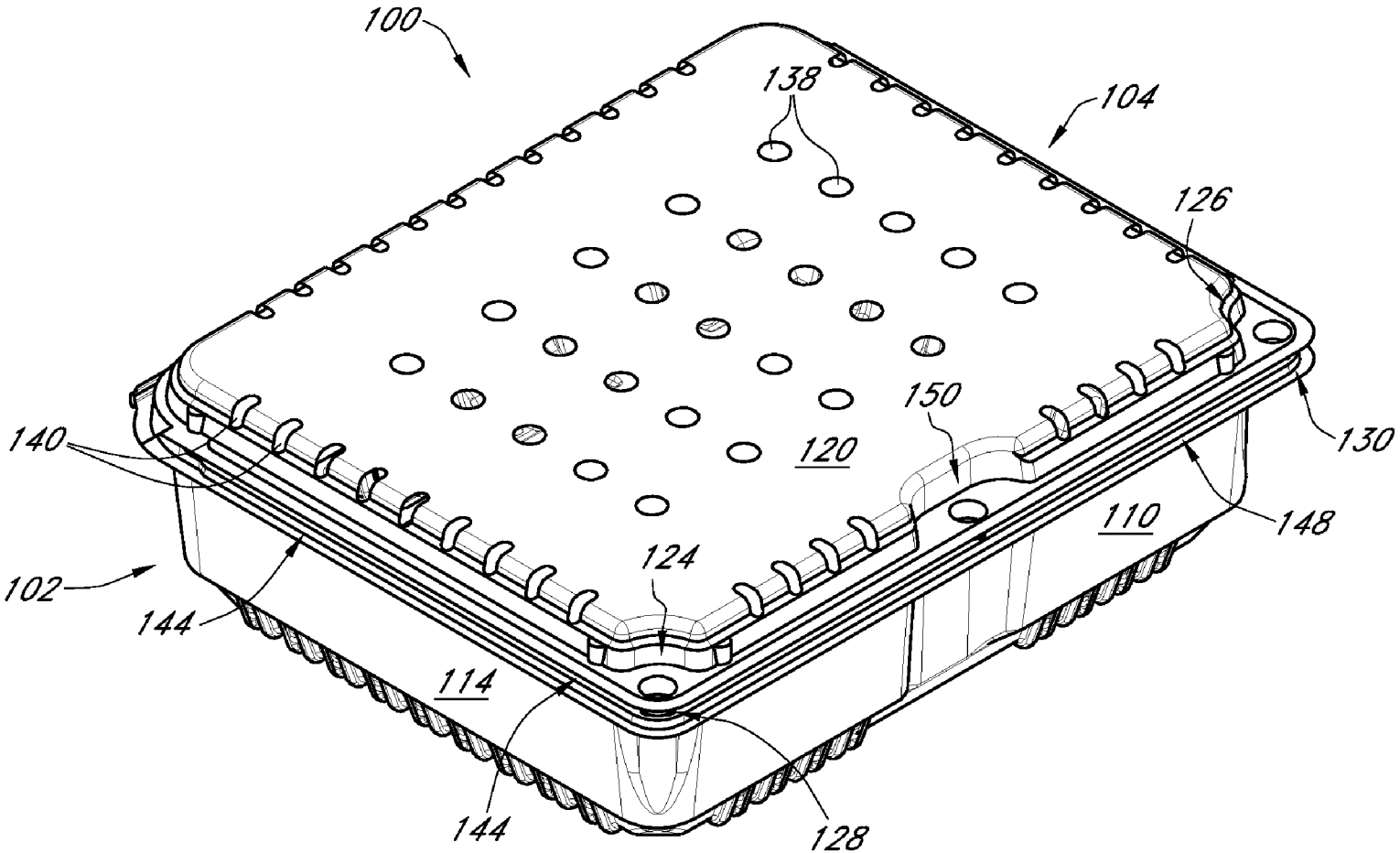
FIG. 2 illustrates a perspective view of the container in FIG. 1 in a closed configuration.

FIG. 2 illustrates a perspective view of the container in FIG. 1 in a closed configuration. As shown, the container 100 may also include a pair of locking mechanisms 128 and 130 to secure the lid 104 to the base 102. In this respect, locking mechanisms 128, 130 facilitate easy closure by packagers and prevent consumers from prematurely or easily opening the container 100 prior to sale. Additionally, locking mechanisms 128, 130 prevent the lid 104 from separating from the base 102 during transportation thereby spilling and/or damaging its contents. The pair of locking mechanisms 128, 130 may include extending latching portions 128*a* and 130*a* (see numerical reference 528*a* of FIG. 5, numerical reference 628*a* of FIG. 6) which may be received by circular openings 128*b* and 130*b* (see numerical reference 828*b* of FIG. 8). When engaged, the extending latching portions 128*a* and 130*a* and circular openings 128*b* and 130*b* snap together thereby securely holding the lid 104 and base 102 of the container 100 together. Although two locking mechanisms 128 and 130 are shown in FIG. 1 and FIG. 2, the container 100 may have only one locking mechanism or may have more than two locking mechanisms.

In one embodiment, the lid 104 may include a first plurality of ventilations apertures 138 on the top of the central raised portion 120 for allowing moisture to escape the container 100 and to allow air to flow through. In another embodiment, the lid 104 may include a second plurality of ventilation apertures 140 along the outer perimeter of the central raised portion 120.

In another embodiment, the base 102 may include a third plurality of ventilation apertures 142 (see FIG. 1). It should be noted that the base 102 and lid 104 may have one or more ventilation apertures or may not include any ventilation apertures at all. The first plurality of ventilation apertures 138 may be generally circular in shape and the second the third plurality of ventilation apertures 140 may be generally rectangular in shape. However, in alternative embodiments, the apertures may be other shapes, such as ovals, triangles, squares, or other polygons. The first plurality of ventilation apertures 138 may be disposed generally symmetrically around the top of surface the central raised portion 120 of the lid 104. In an alternative embodiment, the apertures 138 may be alternatively configured. In yet another alternative embodiment, the container may not include any apertures 138.

The container 100 may be stiffened by including one or more strengtheners, such as an array of ribs (not shown), that may extend in a generally upwardly direction from the bottom 108 of the base 102, to increase the rigidity of the container 100. The ribs may be formed integrally with the container 100. Each wall 110, 112, 114 and 116 may have at least one rib, which at least partially traverses an external surface thereof. The ribs may be generally parallel to one another. According to embodiments of the invention, the container 100 may be made of polyethylene terephthalate (PET), polystyrenes, polypropylenes, or any other suitable material known in the art.

It will be apparent that in closing lid 104 onto base 102, the alignment mechanism, i.e., alignment member 132 and alignment member locating surface 134, will be the first to engage as the lid 104 is closed. Applying further closing pressure causes the extending latching portions 128*a* and 130*a* to be pushed into the circular openings 128*b* and 130*b*, respectively, which, according to some embodiments, may be chamfered rings having flutes that flex when the extending latching portions 128*a* and 130*a* are engaged thereto. When the extending latching portions 128*a* and 130*a* engage with the circular openings 128*b* and 130*b*, a "fish hook type" fit between the corresponding circular openings 128*b* and 130*b* and the extending latching portions 128*a* and 130*a* are created such that the harder an individual attempts to disengage the extending latching portions 128*a* and 130*a* from the circular openings 128*b* and 130*b*, the tighter fitting the lock mechanisms 128, 130 become. However, if enough pulling force is applied, the extending latching portions 128*a* and 130*a* or the circular openings 128*b* and 130*b* will weaken allowing the container to be opened (i.e., the locking mechanisms 128, 130 will disengage) creating a recloseable type lock for the consumer.

When the container 100 is in the closed configuration, the upper and lower flanges 118 and 122, respectively, define a first ventilation gap 144 along the sidewall 114, a second ventilation gap (not shown) along the side wall 116 (not shown), and a front ventilation gap 148 across the front of the container 100. The ventilation gaps 144 and 148, including the second ventilation gap (not shown), allow air to pass through the container 100, which may be important if the contents of the container 100 are perishable food items. While perishable food items, such as fruit or vegetables, are being packaged and transported, such items must remain cold to retain their freshness. The ventilation gaps 144, 146 and 148 allow cool air to flow into the container 100 and, thus, cool its contents. Furthermore, if necessary, the ventilation gaps 144 and 148, including the second ventilation gap (not shown), allow portions of the contents, e.g., stems, leaves, to extend out of the container 100. However, in alternative embodiments, the upper and lower flanges 118 and 124 may be in direct contact with one another when the container is in the closed configuration thereby eliminating any ventilation gaps.

Figure 3:
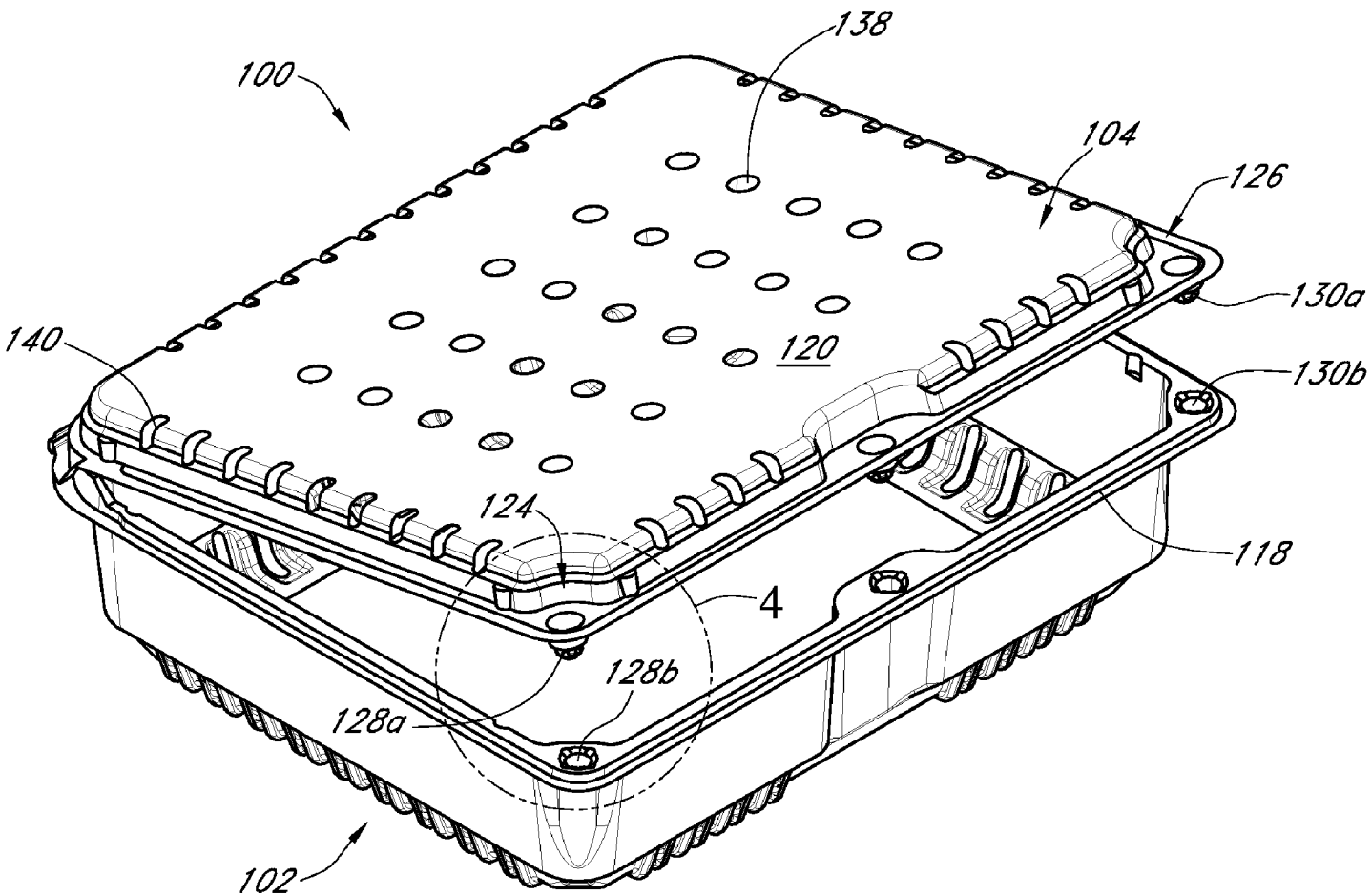
FIG. 3 illustrates a perspective view of the container in FIG. 1 in a partially open configuration.

In one embodiment, the lid 104 may include a center notch 150 similar to that of first and second notches 124, 126 to provide for additional support of the lid 104 to the base 108 in a closed configuration. Similar to the function of first and second notches 124, 126, the center notch 150 may accommodate an individual's thumb or other finger in preparation for securing a third locking mechanism and to allow space for the third locking mechanism. In another embodiment, the lid 104 does not include a center notch. FIG. 3 illustrates a perspective view of the container in FIG. 1 in a partially open configuration.

Figure 4:
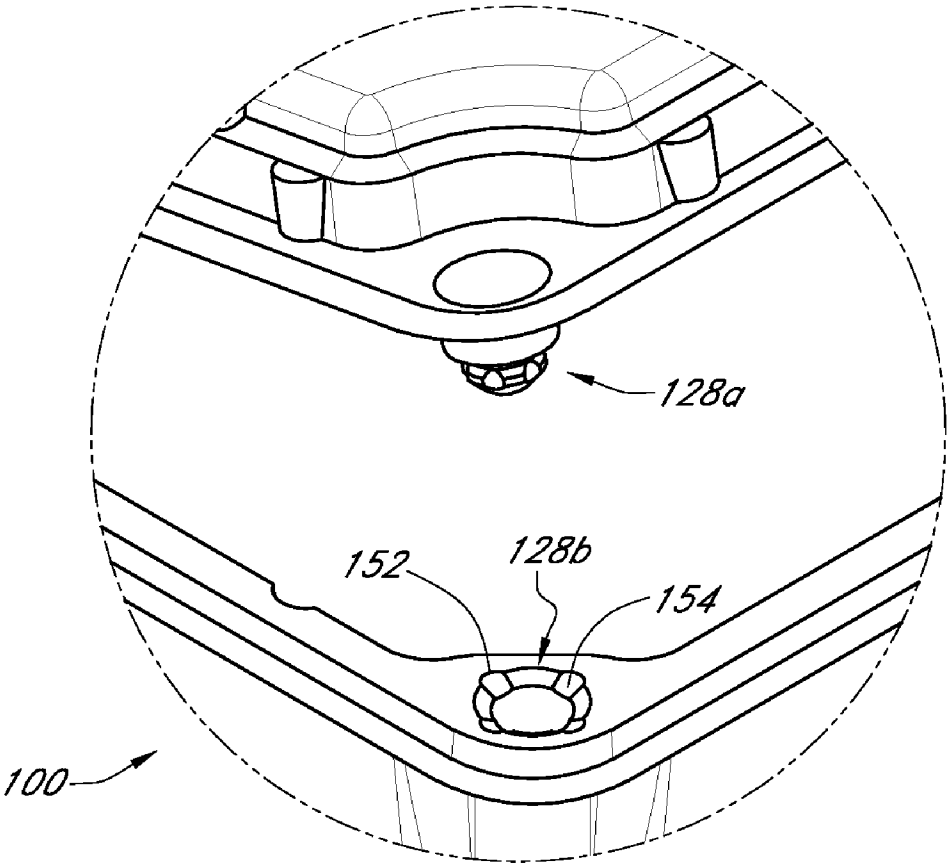
FIG. 4 illustrates a close-up view of a corner of the container in FIG. 3 in a partially open configuration.

FIG. 4 illustrates a close-up view of a corner of the container 100 in FIG. 3 in a partially open configuration. As shown, an extending latching portion 128*a* of a locking mechanism 128 is substantially or completely aligned with a corresponding circular opening 128*b* in preparation for engagement thereto. According to some embodiments, circular opening 128*a* may have a chamfered ring 152 with flutes 154 for allowing the circular opening 128*b* to flex when engaged with the extending latching portion 128*a* (as described previously) of the locking mechanism 128. In this respect, the locking mechanism 128 is flexible such that the container 100 locks securely yet can be opening if enough pulling force is applied thereto.

Figure 5:
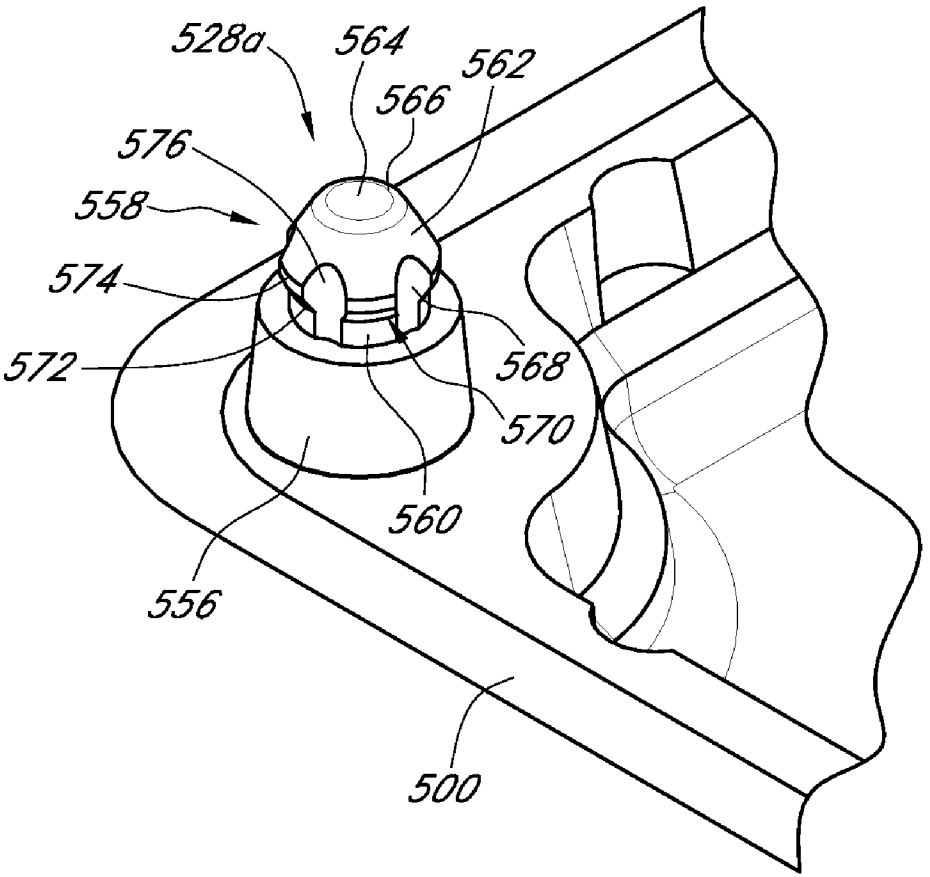
FIG. 5 illustrates a close-up view of an extending latching portion on a lid portion of a container according to an embodiment of the invention.

FIG. 5 illustrates a close-up view of an extending latching portion on a lid portion of a container according to an embodiment of the invention. On a container 500, an extending latching portion 528*a* includes a shank or lower portion 556 having a cylindrical-shaped configuration and a head or upper portion 558 having a substantially circular base 560 and a substantially cone-shaped pin 562 with a circular-shaped flat top 564. In one embodiment, a graded region 566 exists between the circular-shaped flat top 564 and the cone-shaped pin 562. This graded region facilitates engagement of the extending latching portion 528*a* to the corresponding circular opening 528*b*. The head or upper portion 558 may include a plurality of concave grooves 568 separated by a plurality of radially projecting outwardly protrusions 570. The concave grooves 568 uniformly extend upwards from the base 560 of the pin 562 until a first point 572 from where the concave grooves diverge outwardly to a second point 574 and then converge to a rounded end 576 slightly below the flat top 564.

Figure 6:
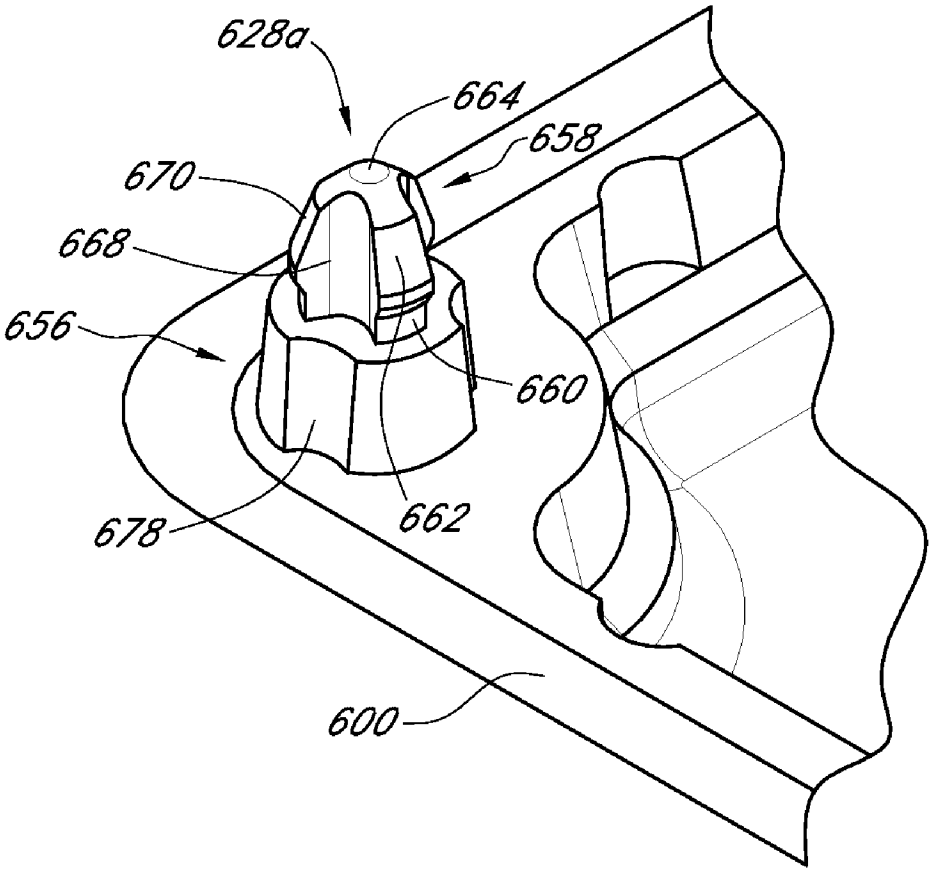
FIG. 6 illustrates a close-up view of an extending latching portion on a lid portion of a container according to a first alternative embodiment of the invention.

FIG. 6 illustrates a close-up view of an extending latching portion on a lid portion of a container according to a first alternative embodiment of the invention. On a container 600, an extending latching portion 628*a* includes a shank or lower portion 656 having a cylindrical-shaped configuration having a plurality of recesses 678 and a head or upper portion 658 having an approximately circular base 660 and a substantially cone-shaped pin 662 with a flat top 664. The head or upper portion 658 may include a plurality of concave grooves 668 separated by a plurality of radially projecting outwardly protrusions 670. In one embodiment, the plurality of recesses 678 (on the lower portion 656) are substantially aligned relative to the plurality of concave grooves 668 (on the upper portion 658). This feature may facilitate locking of a locking mechanism of which the extending latching portion 628*a* is one component.

Figure 7:
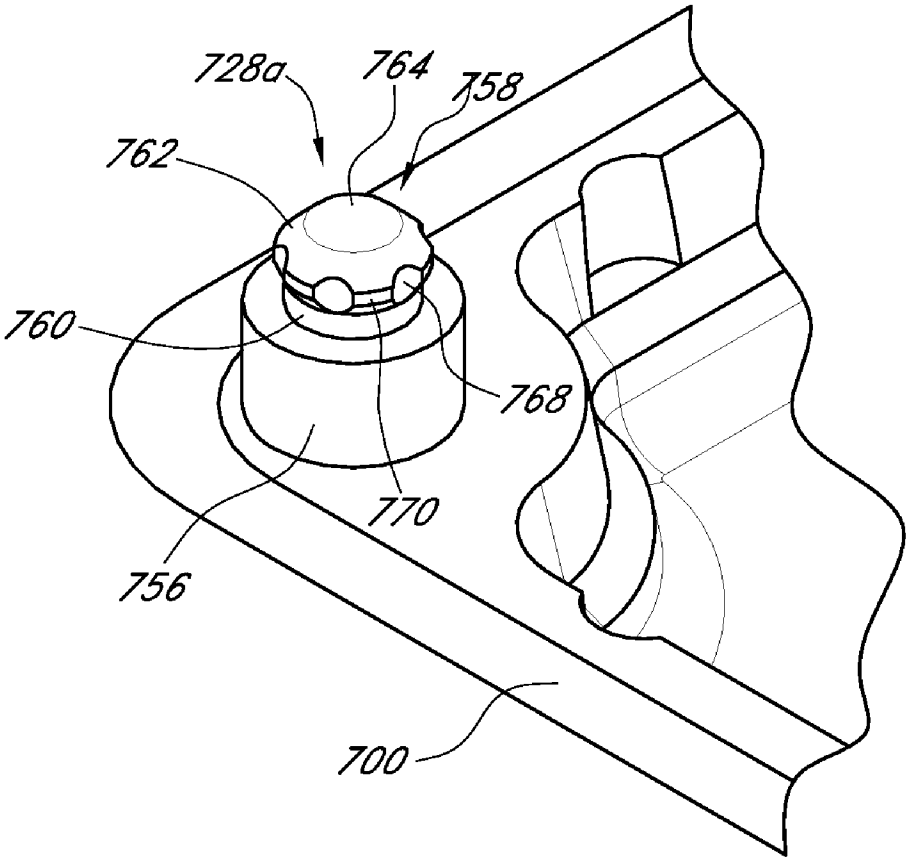
FIG. 7 illustrates a close-up view of an extending latching portion on a lid portion of a container according to a second alternative embodiment of the invention.

FIG. 7 illustrates a close-up view of an extending latching portion on a lid portion of a container according to a second alternative embodiment of the invention. On a container 700, an extending latching portion 728*a* includes a shank or lower portion 756 having a cylindrical-shaped configuration and a head or upper portion 758 having a substantially circular base 760 and an approximately cone-shaped pin 762 with a concave-shaped top 764. The head or upper portion 758 may include a plurality of concave grooves 768 separated by a plurality of radially projecting outwardly protrusions 770. In one embodiment, the cone-shaped pin 762 angles outwardly relative to base 760, then continues upwardly substantially perpendicular (relative to the ground), then continues upwardly to converge at a center of concave-shaped top 764. The concave grooves 768 may be symmetrically positioned about the pin 762.

Figure 8:
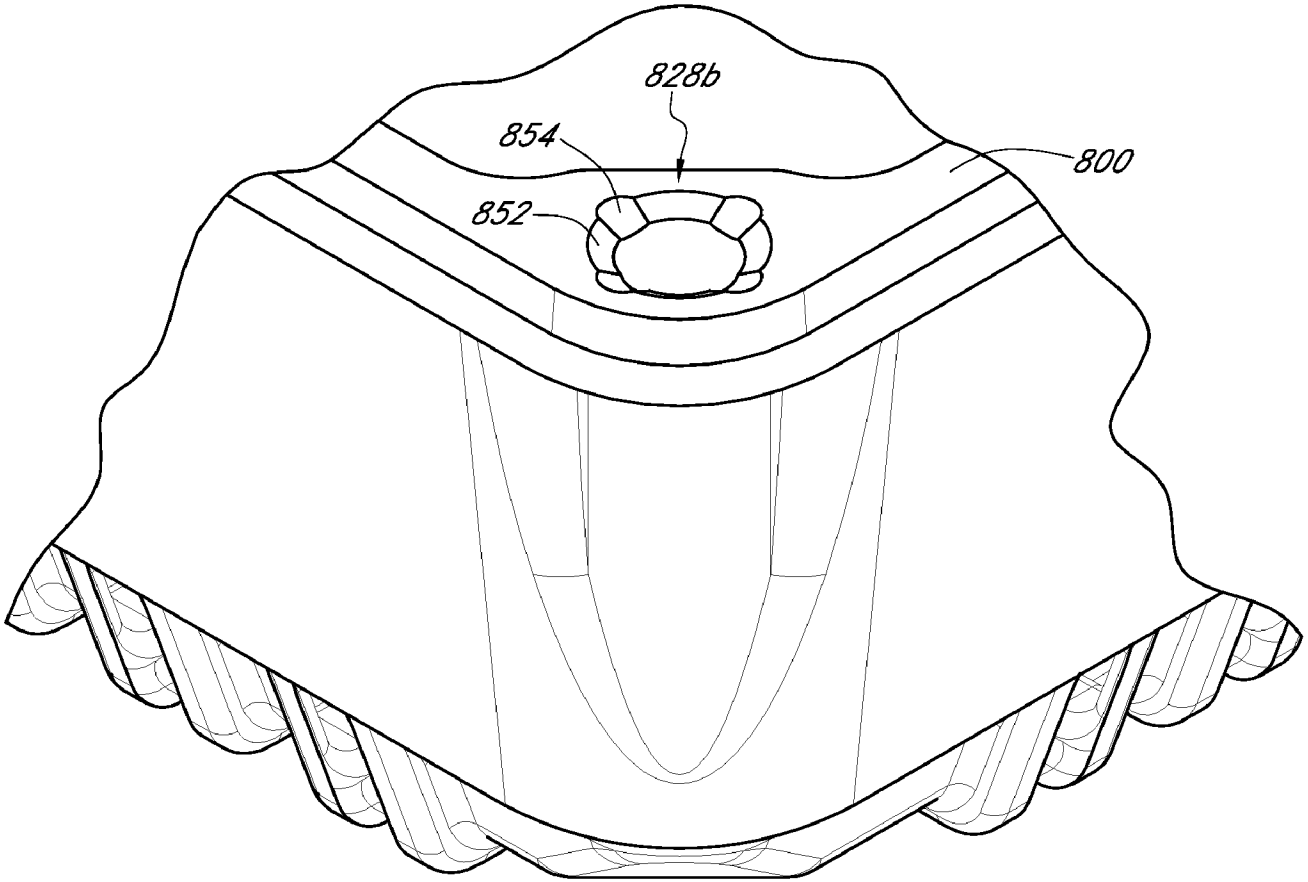
FIG. 8 illustrates a top close-up view of a circular opening on a bottom portion of a container according to an embodiment of the invention.

FIG. 8 illustrates a top close-up view of a circular opening on a bottom portion of a container according to an embodiment of the invention. A circular opening 828*b* may include a chamfered ring 852 with flutes 854 for allowing the circular opening 828*b* to flex when engaged with an extending latching portion as described above with reference to FIGS. 5, 6 and 7. Furthermore, when the extending latching portion engages with the circular opening 828*b*, a "fish hook type" between the circular opening 828*b* and the extending latching portion is created such that the harder an individual attempts to disengage the extending latching portion from the circular opening 828*b*, the tighter fitting the locking mechanism becomes. However, if enough pulling force is applied, the extending latching portion or the circular opening 828*b* will weaken allowing the container 800 to be opened (i.e., the locking mechanism will disengage) creating a recloseable type lock for the consumer.

Figure 9:
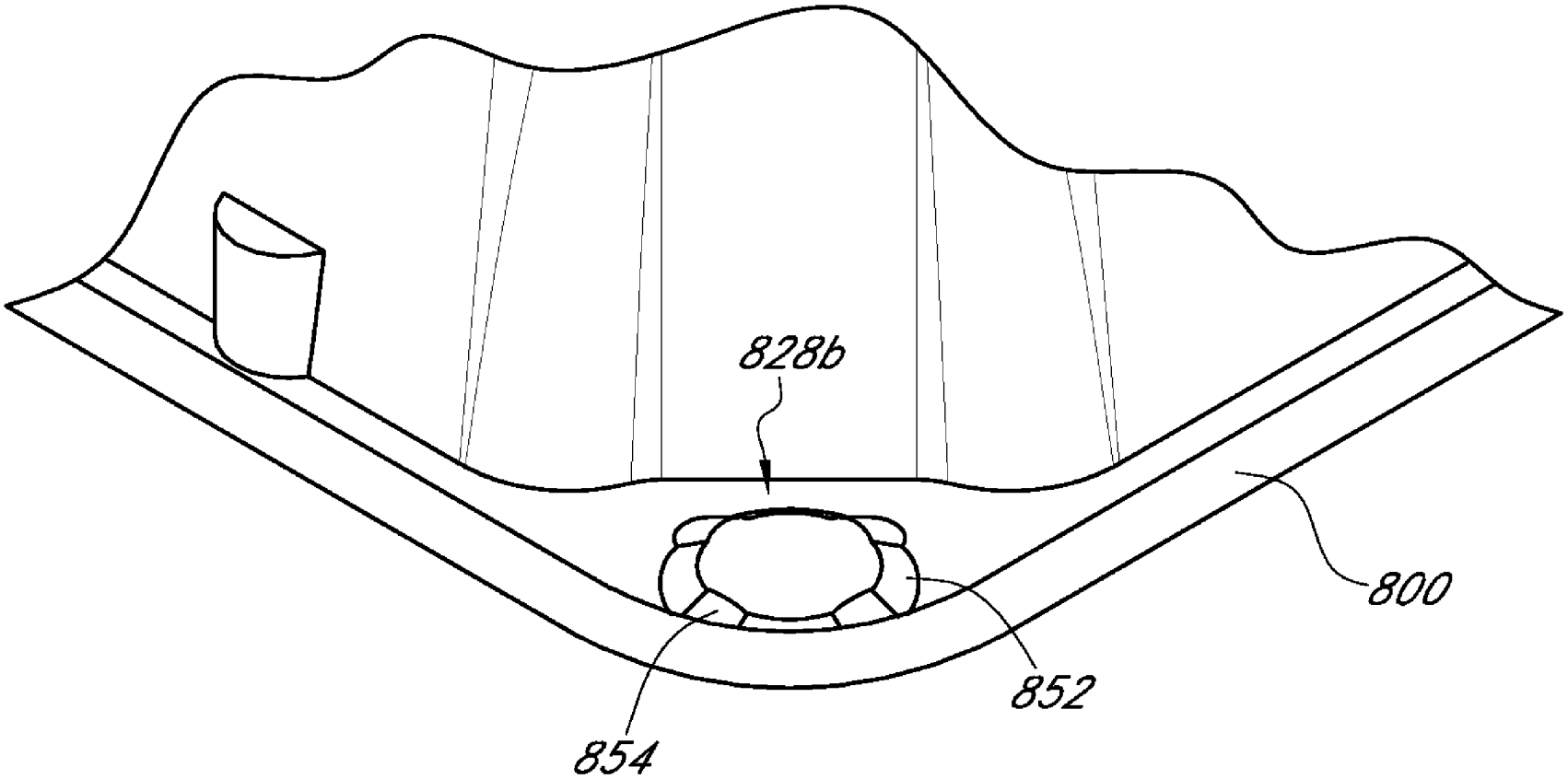
FIG. 9 illustrates a bottom close-up view of the circular opening on the bottom portion of the container of FIG. 8.

FIG. 9 illustrates a bottom close-up view of the circular opening on the bottom portion of the container of FIG. 8. The circular opening 828*b* may include a chamfered ring 852 with flutes 854 for allowing the circular opening 828*b* to flex when engaged with an extending latching portion as described above with reference to FIGS. 5, 6 and 7.

Figure 10:
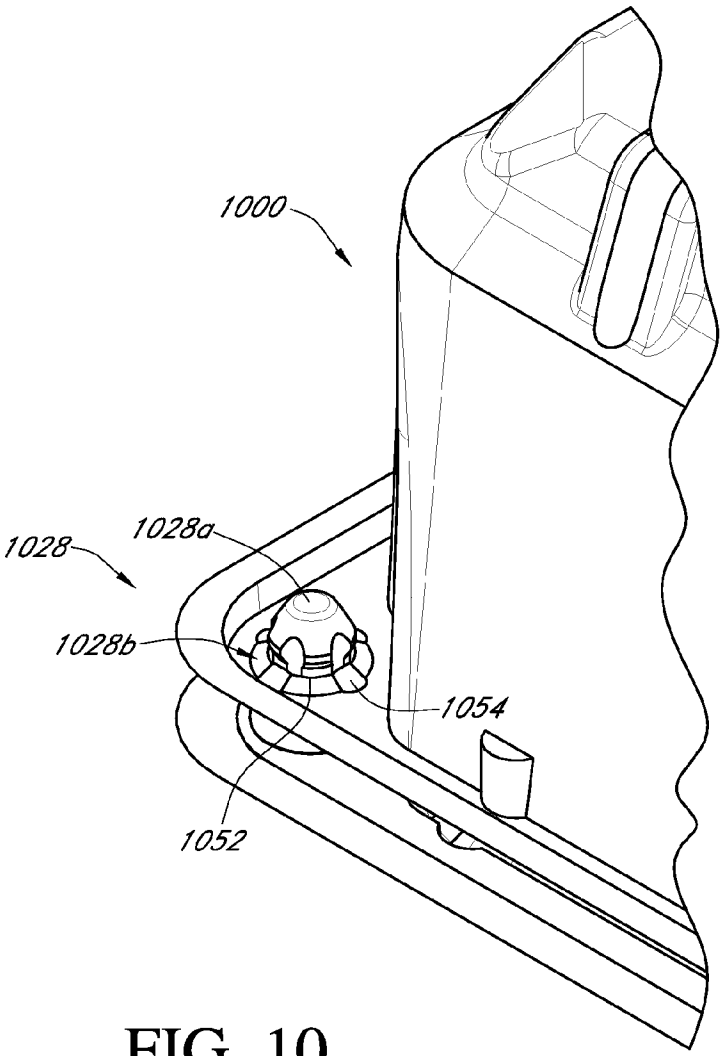
FIG. 10 illustrates a bottom close-up view of a corner of a container in a closed configuration according to an embodiment of the invention.

FIG. 10 illustrates a bottom close-up view of a corner of a container in a closed configuration showing an extending latching portion 1028*a* of a locking mechanism 1028 engaged with a corresponding circular opening 1028*b* of the locking mechanism according to an embodiment of the invention. The circular opening 1028*b* may include a chamfered ring 1052 with flutes 1054 for allowing the circular opening 1028*b* to flex when engaged with the extending latching portion 1028*a*. As described above, when the extending latching portion 1028*a* engages with the circular opening 1028*b*, a "fish hook type" between the circular opening 1028*b* and the extending latching portion 1028*a* is created such that the harder an individual attempts to disengage the extending latching portion 1028*a* from the circular opening 1028*b*, the tighter fitting the locking mechanism 1028 becomes. However, if enough pulling force is applied, the extending latching portion 1028*a* or the circular opening 1028*b* will weaken allowing the container 1000 to be opened (i.e., the locking mechanism 1028 will disengage) creating a recloseable type lock for the consumer.

Figure 11:
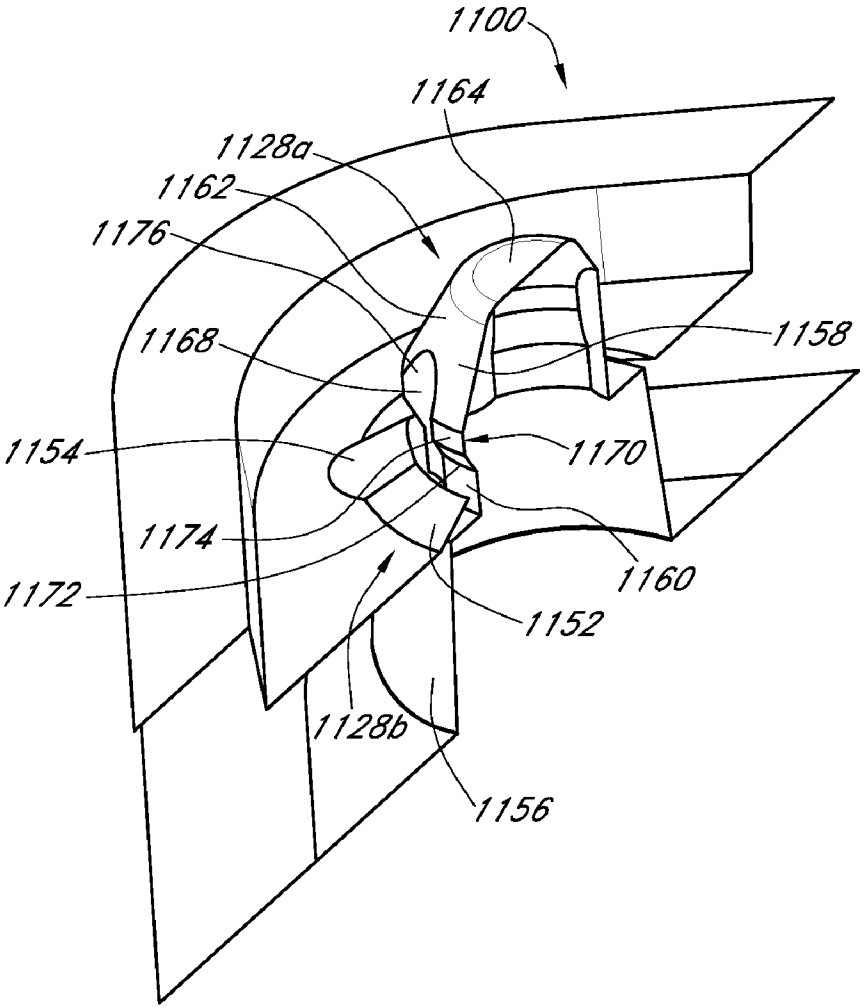
FIG. 11 illustrates a perspective partial cross-sectional view of a locking mechanism of a container according to an embodiment of the invention.

FIG. 11 illustrates a perspective partial cross-sectional view of a locking mechanism of a container according to an embodiment of the invention. The locking mechanism 1128 (collectively 1128*a*, 1128*b*) includes a circular opening 1128*b* and an extending latching portion 1128*a*. The circular opening 1128*b* may include a chamfered ring 1152 with flutes 1154 for allowing the circular opening 1128*b* to flex when engaged with the extending latching portion 1128*a*. Furthermore, when the extending latching portion 1128*a* is engaged with the circular opening 1128*b*, a "fish hook type" between the circular opening 1128*b* and the extending latching portion 1128*a* is created such that the harder an individual attempts to disengage the extending latching portion 1128*a* from the circular opening 1128*b*, the tighter fitting the locking mechanism 1128 becomes. However, if enough pulling force is applied, the extending latching portion 1128*a* or the circular opening 1128*b* will weaken allowing the container 1100 to be opened (i.e., the locking mechanism 1128 will disengage) creating a recloseable type lock for the consumer. Because a pin 1162 of the extending latching portion 1128*a* has a larger circumference than the circumference of the circular opening 1128*b*, it is difficult to disengage the extending latching portion 1128*b* from the circular portion 1128*b* without applying an appropriate amount of pulling force. That is, the inner edge of the circular opening 1128*b* is blocked by the pin 1162 of the extending latching portion 1128*a*.

As described with respect to FIGS. 5, 6 and 7, the extending latching member 1128*a* includes a shank or lower portion 1156 having a cylindrical-shaped configuration and a head or upper portion 1158 having a substantially circular base 1160 and a substantially cone shaped pin 1162 with a flat top 1164. The head or upper portion 1158 may include a plurality of concave grooves 1168 separated by a plurality of radially projecting outwardly protrusions 1170. The concave grooves 1168 uniformly extend upwards from the base 1160 of the pin 1162 until a first point 1172 from where the concave grooves diverge outwardly to a second point 1174 and then converge to a rounded end 1176 slightly below the flat top 1164.

Figure 12:
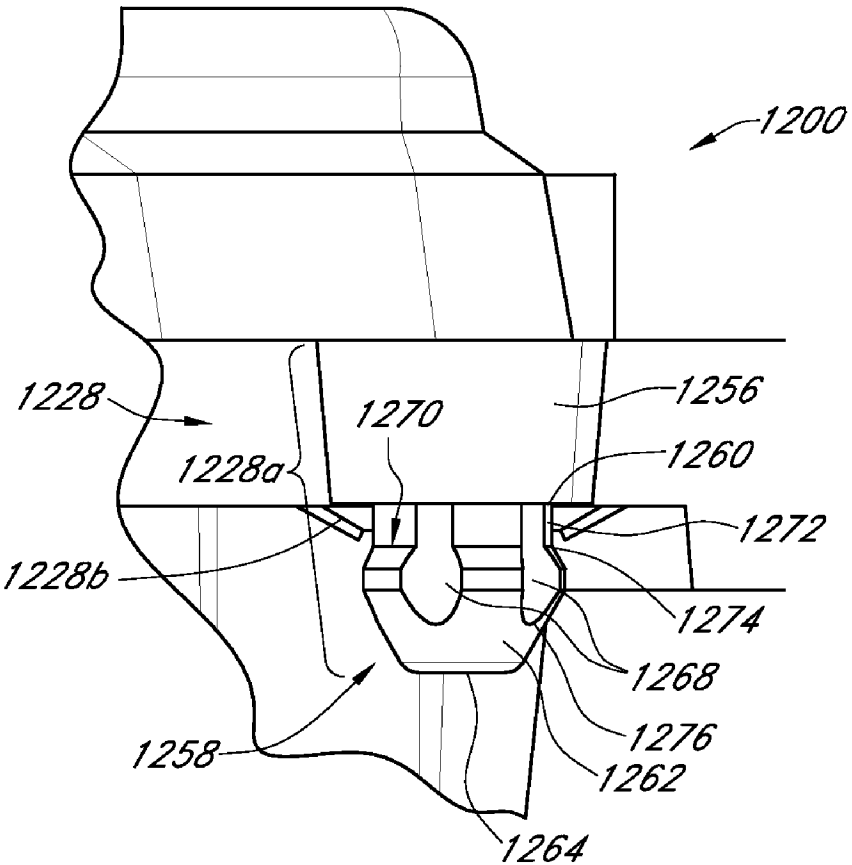
FIG. 12 illustrates a side partial cross-sectional view of an engaged locking mechanism according to an embodiment of the invention.

FIG. 12 illustrates a side partial cross-sectional view of an engaged locking mechanism 1228 of a container 1200. The locking mechanism 1228 includes a circular opening 1228*b* (as described above) and an extending latching portion 1228*a* having a shank or lower portion 1256 having a cylindrical-shaped configuration and a head or upper portion 1258 having a substantially circular base 1260 and a substantially cone-shaped pin 1262 with a flat top 1264. The head or upper portion 1258 may include a plurality of concave grooves 1268 separated by a plurality of radially projecting outwardly protrusions 1270. The concave grooves 1268 uniformly extend upwards from the base 1260 of the pin 1262 until a first point 1272 from where the concave grooves 1268 diverge outwardly to a second point 1274 and then converge to a rounded end 1276 slightly below the flat top 1264.

Figure 13:
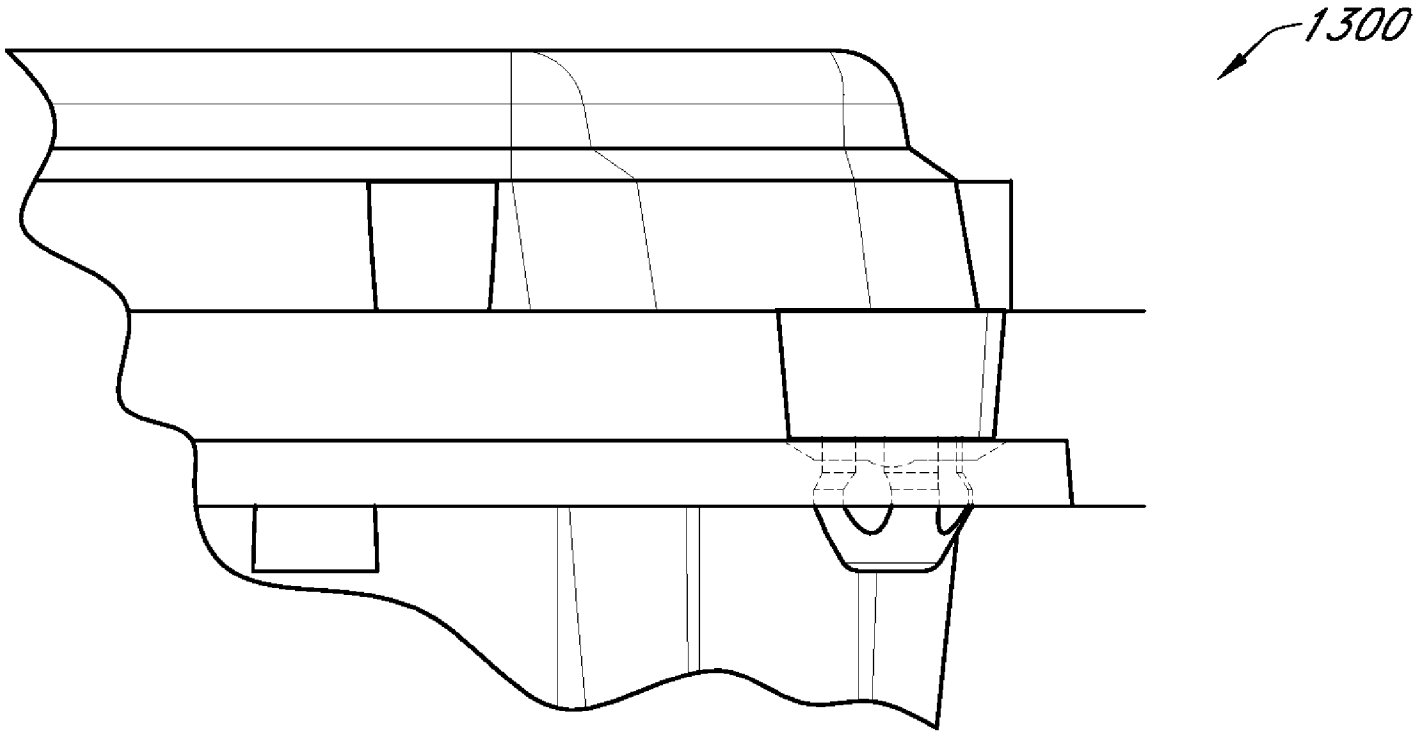
FIG. 13 illustrates a fragmentary view of a container in a closed configuration showing an extending member and a circular opening of a locking mechanism in an engaged position according to an embodiment of the invention.

FIG. 13 illustrates a fragmentary view of a container 1300 in a closed configuration showing an extending member and a circular opening of a locking mechanism in an engaged position according to an embodiment of the invention.

It should also be noted that the locking mechanisms described above may be utilized for any type, size and shape container and not merely in a rectangular shaped container as shown in the previous figures. In one embodiment, the locking mechanism may be utilized in a two-piece container.

It should also be noted that although the extending latching portions of the locking mechanisms shown and described as having a circular base and a cone shaped pin, the base and the pin may be any other shape, such as ovals, triangles, squares, or other polygons.

In one embodiment, the various locking mechanism of the present inventions (described above) may be utilized in a two-piece container, i.e. a container has a base and a lid that are not attached by a hinge and are each separate parts. In such an embodiment, four locking mechanisms may be utilized. For example, in a square or rectangular container, a locking mechanism may be utilized for each corner. The lid may have four extending latching portions and the base may have four opening to engage the four extending latching portions when the lid is secured to the base. It should be noted that a two-piece container may have less than or more than four locking mechanisms. It should also be noted that a two-piece container may be of any shape, such as oval, circle, triangular or any other shape.

One or more of the components and functions illustrated in the previous figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A locking mechanism for a container, comprising:

a circular opening; and an extending latching portion for insertion into the circular opening, the extending latching portion comprising:

a substantially circular lower portion having a decreasing diameter, tapering inwardly from a first end to a second end; and an upper portion integrally connected to the second end of the lower portion, the upper portion comprising:

a substantially circular base;

a substantially cone-shaped pin integrally connected to the circular base at a first point; and a plurality of concave grooves located in the substantially cone-shaped pin separated by a plurality of radially projecting protrusions.

2. The locking mechanism of claim 1, wherein the plurality of concave grooves extend vertically through the circular base of the upper portion to the first point, diverge outwardly from the first point to a second point and then converge to a rounded end.

3. The locking mechanism of claim 2, wherein the plurality of radially projecting protrusions extend from the first point to the second point in the upper portion.

4. The locking mechanism of claim 1, wherein the substantially cone-shaped pin has a substantially circular-shaped flat top.

5. The locking mechanism of claim 4, further comprising a graded region, encircling the substantially cone-shaped pin integrally connected to the substantially circular-shaped flat top, for facilitating engagement of the extending latching portion with the circular opening.

6. The locking mechanism of claim 1, wherein the plurality of radially projecting protrusions are located perpendicular to the plurality of concave grooves.

7. The locking mechanism of claim 1, wherein the substantially circular lower portion has a plurality or recesses extending from the first end to the second end.

8. The locking mechanism of claim 7, wherein the plurality or recesses extending in the substantially circular lower portion are in direct alignment with the plurality of concave grooves in the upper portion.

9. The locking mechanism of claim 1, wherein the circular opening has a chamfered ring having a plurality of flutes plurality.

10. A container, comprising:

a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange comprising at least two circular openings; and a lid hingedly connected to the base, the lid comprising at least two extending latching portions for insertion into the at least two circular openings, each of the two extending latching portion comprising:

a substantially circular lower portion having decreasing diameter tapering inwardly from a first end to a second end; and an upper portion integrally connected to the second end of the lower portion, the upper portion comprising:

a substantially circular base;

a substantially cone-shaped pin integrally connected to the circular base at a first point; and a plurality of concave grooves located in the substantially cone-shaped pin separated by a plurality of radially projecting protrusions.

11. The locking mechanism of claim 10, wherein the plurality of concave grooves extend vertically through the circular base of the upper portion to the first point, diverge outwardly from the first point to a second point and then converge to a rounded end.

12. The locking mechanism of claim 11, wherein the plurality of radially projecting protrusions extend from the first point to the second point in the upper portion.

13. The locking mechanism of claim 10, wherein the substantially cone-shaped pin has a substantially circular-shaped flat top.

14. The locking mechanism of claim 13, further comprising a graded region, encircling the substantially cone-shaped pin integrally connected to the substantially circular-shaped flat top, for facilitating engagement of the at least two extending latching portions with the at least two circular openings.

15. The locking mechanism of claim 10, wherein the plurality of radially projecting protrusions are located perpendicular to the plurality of concave grooves.

16. The locking mechanism of claim 10, wherein the substantially circular lower portion has a plurality or recesses extending from the first end to the second end.

17. The locking mechanism of claim 16, wherein the plurality or recesses extending in the substantially circular lower portion are in direct alignment with the plurality of concave grooves in the upper portion.

18. The locking mechanism of claim 10, wherein the at least two circular openings having a chamfered ring having a plurality of flutes plurality.

19. A container, comprising:

a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange comprising at least two circular openings having a chamfered ring having a plurality of flutes; and a lid hingedly connected to the base, the lid comprising at least two extending latching portions for insertion into the at least two openings, each of the two extending latching portion comprising:

a substantially circular lower portion having a decreasing diameter tapering inwardly from a first end to a second end; and an upper portion integrally connected to the second end of the lower portion, the upper portion comprising:

a substantially circular base;

a substantially cone-shaped pin, integrally connected to the circular base at a first point, having a substantially circular-shaped flat top;

a graded region, encircling the substantially cone-shaped pin integrally connected to the substantially circular-shaped flat top, for facilitating engagement of the extending latching portion with the circular opening; and a plurality of concave grooves located in the substantially cone-shaped pin separated by a plurality of radially projecting protrusions, the plurality of concave grooves extend vertically through the circular base of the upper portion to the first point, diverge outwardly from the first point to a second point and then converge to a rounded end and the plurality of radially projecting protrusions extend from the first point to the second point in the upper portion.

* * * * *